US009435337B2

(12) United States Patent
Sakuda et al.

(10) Patent No.: US 9,435,337 B2
(45) Date of Patent: Sep. 6, 2016

(54) SCROLL COMPRESSOR

(71) Applicant: Panasonic Corporation, Osaka (JP)

(72) Inventors: Atsushi Sakuda, Shiga (JP); Sadayuki Yamada, Shiga (JP); Takeshi Ogata, Osaka (JP); Yusuke Imai, Shiga (JP); Hidenobu Shintaku, Shiga (JP); Takashi Morimoto, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 91 days.

(21) Appl. No.: 14/378,844

(22) PCT Filed: Nov. 12, 2013

(86) PCT No.: PCT/JP2013/006641
§ 371 (c)(1),
(2) Date: Aug. 14, 2014

(87) PCT Pub. No.: WO2014/103136
PCT Pub. Date: Jul. 3, 2014

(65) Prior Publication Data

US 2015/0056091 A1 Feb. 26, 2015

(30) Foreign Application Priority Data

Dec. 27, 2012 (JP) ..... 2012-284176

(51) Int. Cl.
*F01C 1/02* (2006.01)
*F04C 2/02* (2006.01)
(Continued)

(52) U.S. Cl.
CPC ..... *F04C 2/025* (2013.01); *F04C 13/001* (2013.01); *F04C 18/0215* (2013.01);
(Continued)

(58) Field of Classification Search
CPC ..... F04C 18/0207; F04C 18/025; F04C 18/0215; F04C 18/02; F04C 18/0223; F04C 18/023; F04C 18/0238; F04C 18/0253; F04C 18/0246; F04C 2/02; F04C 2/025; F04C 2240/50; F04C 2240/56; F04C 2250/60; F04C 2240/605; F01C 1/02; F01C 1/0223
USPC ..... 418/55.1, 55.2, 55.3, 55.4, 55.5, 55.6
See application file for complete search history.

(56) References Cited

U.S. PATENT DOCUMENTS 4,761,122 A * 8/1988 Matsugi ..... F01C 1/0215 384/420
5,174,739 A * 12/1992 Kim ..... F04C 29/0057 418/55.5

(Continued)

FOREIGN PATENT DOCUMENTS

CN 1302954 7/2001
CN 202203271 4/2012

(Continued)

OTHER PUBLICATIONS

NPL: Qiao—The Charater of Sliding Bearings in the Scroll Compressor, 1994.*

(Continued)

*Primary Examiner* — Patrick Maines
(74) *Attorney, Agent, or Firm* — Hamre, Schumann, Mueller & Larson, P.C.

(57) ABSTRACT

A diameter of a main bearing member 12*m* is defined as Dm, a length thereof is defined as Lm, a diameter of the eccentric bearing member 11*e* is defined as De and a length thereof is defined as Le. A ratio (=Lm/Dm) of the length and the diameter of the main bearing member 12*m* and a ratio (=Le/De) of the length and the diameter of the eccentric bearing member 11*e* are set to Le/De≤Lm/Dm≤1. Therefore, contact at edge portions of both ends of the eccentric bearing member 11*e* does not occur, and it is possible to prevent contact at edge portions of both ends of the main bearing member 12*m* even if the main shaft 13*m* inclines, and to reduce a viscosity loss caused by oil 9*a*. Hence, the present invention provides a scroll compressor securing reliability of the bearing members 12*m*, 11*e* and 16*s* and having high efficiency.

5 Claims, 3 Drawing Sheets

(51) Int. Cl.

| | |
|---|---|
| ***F04C 29/00*** | (2006.01) |
| ***F04C 18/02*** | (2006.01) |
| ***F04C 13/00*** | (2006.01) |
| *F04C 28/28* | (2006.01) |

(52) U.S. Cl.
CPC ..... *F04C 29/0057* (2013.01); *F04C 28/28* (2013.01); *F04C 2240/50* (2013.01); *F04C 2240/60* (2013.01); *F04C 2270/17* (2013.01)

(56) References Cited

U.S. PATENT DOCUMENTS

| | | | | |
|---|---|---|---|---|
| 5,542,829 | A | 8/1996 | Inagaki et al. | |
| 6,179,591 | B1 | 1/2001 | Clendenin et al. | |
| 2004/0170509 | A1* | 9/2004 | Wehrenberg | F04C 29/045 417/371 |
| 2004/0247474 | A1* | 12/2004 | Kitaura | F04C 29/028 418/55.4 |
| 2007/0224071 | A1* | 9/2007 | Wang | F04C 28/24 418/55.5 |
| 2009/0246057 | A1* | 10/2009 | Sugimoto | F04C 18/0215 418/55.1 |
| 2010/0150752 | A1* | 6/2010 | Nakamura | F04C 29/028 417/410.5 |
| 2014/0301880 | A1* | 10/2014 | Horibe | C10M 147/02 418/55.1 |

FOREIGN PATENT DOCUMENTS

| | | | | |
|---|---|---|---|---|
| JP | 62-168986 | | 7/1987 | |
| JP | 5-26181 | | 2/1993 | |
| JP | 7-167067 | | 7/1995 | |
| JP | 2000-130364 | | 5/2000 | |
| JP | 3152472 | | 4/2001 | |
| JP | 3152472 | B2 * | 4/2001 | F04C 18/0215 |
| JP | 3731068 | | 1/2006 | |
| JP | 3731068 | B2 * | 1/2006 | F04C 27/009 |
| JP | 2006-118396 | | 5/2006 | |
| JP | 2007-247562 | | 9/2007 | |
| JP | 2012-57637 | | 3/2012 | |
| JP | 2012057637 | A * | 3/2012 | |
| JP | 3152472 | | 4/2013 | |
| JP | EP 2905469 | A1 * | 8/2015 | F04C 23/008 |

OTHER PUBLICATIONS

Machine Translation of JP-3152472, Translated on Jan. 7, 2015.*
Office Action issued Sep. 21, 2015 in corresponding Chinese patent application and English translation thereof, 7 pages total.
Search Report issued Sep. 1, 2015 in corresponding Chinese patent application and English translation thereof, 4 pages total.
Qiao et al., "Property of sliding bearing in scroll compressor," Compressor Technology, Issue 6, Dec. 30, 1994, pp. 34-37 and English language translation thereof (10 pages total).

* cited by examiner $$\delta m(=\delta 1m+\delta 2m)=\frac{10\sim 40}{10,000}\times Dm$$

$$\delta e(=\delta 1e+\delta 2e)=\frac{10\sim 40}{10,000}\times De$$

$$\delta s(=\delta 1s+\delta 2s)=\frac{10\sim 40}{10,000}\times Ds$$

SCROLL COMPRESSOR

TECHNICAL FIELD

The present invention relates to a scroll compressor used for an air conditioner, a cooling device such as a refrigerator, a heat pump type water heater and a hot water heating system.

BACKGROUND TECHNIQUE

A conventional compressor used for an air conditioner and a cooling device generally includes a compression mechanism and an electric motor for driving the compression mechanism, and the compression mechanism and the motor are accommodated in a casing. In the compressor, refrigerant gas which returned from the refrigeration cycle is compressed by the compression mechanism, and the refrigerant gas is sent to a refrigeration cycle. When the refrigerant gas is compressed, a gas compression force is applied to the compression mechanism, and this load is supported by a journal bearing. Generally, an axial length of the journal bearing is increased, thereby reducing a surface pressure, and reliability of the journal bearing is secured. Especially in the case of an eccentric bearing, there is tendency that a diameter thereof is smaller than that of a main bearing and a length of the eccentric bearing is relatively increased, thereby reducing a surface pressure of the eccentric bearing (see patent document 1 for example). Here, a diameter of a main bearing member is defined as Dm, a length thereof is defined as Lm, a diameter of an eccentric bearing member is defined as De and a length thereof is defined as Le. Then, a relation $Lm/Dm<Le/De$ is established in patent document 1. This is because the diameter De of the eccentric bearing member becomes small and as a result, Le/De becomes great. That is, a ratio (=Le/De) of the length and the diameter of the eccentric bearing member is made greater than a ratio (=Lm/Dm) of the length and the diameter of the main bearing member. According to this, reliability of both the bearing members and shafts is ensured.

There is also such a configuration that the length Lm of the main bearing member is increased to establish a relation $Lm/Dm>Le/De$ (see patent document 2 for example). The length of the main bearing member is increased, thereby increasing a contact distance between the shaft and the bearing member, and inclination of the shaft is suppressed. That is, reliability of both the bearing members and shafts are ensured like patent document 1.

PRIOR ART DOCUMENT

Patent Documents

[Patent Document 1] Japanese Patent No.3731068
[Patent Document 2] Japanese Patent No.3152472

SUMMARY OF THE INVENTION

Problem to be Solved by the Invention

In the conventional configuration shown in patent document 1, however, when the compressor is operated in a state where the shaft inclines, the main bearing member and a main shaft, or the eccentric bearing member and an eccentric shaft come into contact with each other at edge portions of both ends of the bearing member, and they receive gas compression forces at the edge portions. Especially since the gas compression force is applied to the eccentric shaft, a bending amount in the eccentric shaft is increased and the eccentric shaft inclines greater than the main shaft. If a tilting phenomenon of a rotary scroll is generated, contact frequency at the edge portion of the eccentric bearing member becomes higher than contact frequency at the edge portion of the main bearing member. If contact at the edge portion is generated, since a contact area between the bearing member and the shaft is extremely small, a surface pressure becomes extremely high. Therefore, a local wear or abrasion is generated on the bearing member or the shaft. If the operation of the compressor is continued in this sate, the abrasion progresses and there is fear that reliability of the compressor is deteriorated.

According to the conventional configuration of patent document 2, since the main bearing member is long, inclination of the main shaft is suppressed by the main bearing member and inclination of the eccentric shaft is also suppressed. As a result, contact of the eccentric bearing member at the edge portion is resolved. Further, oil film is sufficiently formed between the main bearing member and the main shaft, oil film around the edge portion of the main bearing member receives a gas compression force, and there is a tendency that a surface pressure acting on the main bearing member and the main shaft is reduced. However, if a sliding area between the main bearing member and the main shaft becomes excessively large, since a viscosity loss is increased by oil, there is a problem that compression performance is deteriorated.

The present invention has been accomplished to solve the above-described conventional problems, and it is an object of the invention to provide an efficient scroll compressor realizing high reliability by suppressing local wear of a bearing member or a shaft and suppressing a viscosity loss.

Means for Solving the Problem

The present invention provides a scroll compressor in which a compression mechanism and a motor are accommodated in a hermetic container, the compression mechanism includes: a fixed scroll having a spiral lap rising from a paneling; a rotary scroll having a spiral lap also rising from a paneling, and meshing with the fixed scroll to form a plurality of compression chambers; a shaft; a main frame supporting the shaft; and a rotation-regulating mechanism for regulating an attitude of the rotary scroll, and in which an eccentric shaft is integrally formed on one end of the shaft, the eccentric shaft is fitted into an eccentric bearing member formed in the rotary scroll, a main shaft of the shaft is fitted into a main bearing member formed in the main frame, refrigerant compressed by the compression mechanism is discharged from a discharge port of the fixed scroll, wherein when a diameter of the main bearing member is defined as Dm and a length thereof is defined as Lm and a diameter of the eccentric bearing member is defined as De and a length thereof is defined as Le, a ratio (=Lm/Dm) of the length and the diameter of the main bearing member and a ratio (=Le/De) of the length and the diameter of the eccentric bearing member satisfy a relation $Le/De \leq Lm/Dm \leq 1$.

According to this, it is possible to provide a scroll compressor realizing high reliability and high efficiency.

Effect of the Invention

According to the present invention, it is possible to prevent so-called twisting in which when a shaft inclines, and the shaft comes into contact with the edge portions of both ends of the bearing member. That is, since it is possible to prevent a surface pressure from increasing, it is possible to suppress local wear of the bearing member and the shaft.

According to the invention, it is possible to ensure reliability of the bearing member, especially reliability of the eccentric bearing member without increasing a length of the main bearing member. That is, it is possible to reduce a viscosity loss generated if oil exists between the main bearing member and the main shaft, and high reliability can be realized.

EXPLANATION OF SYMBOLS

Figure 1:
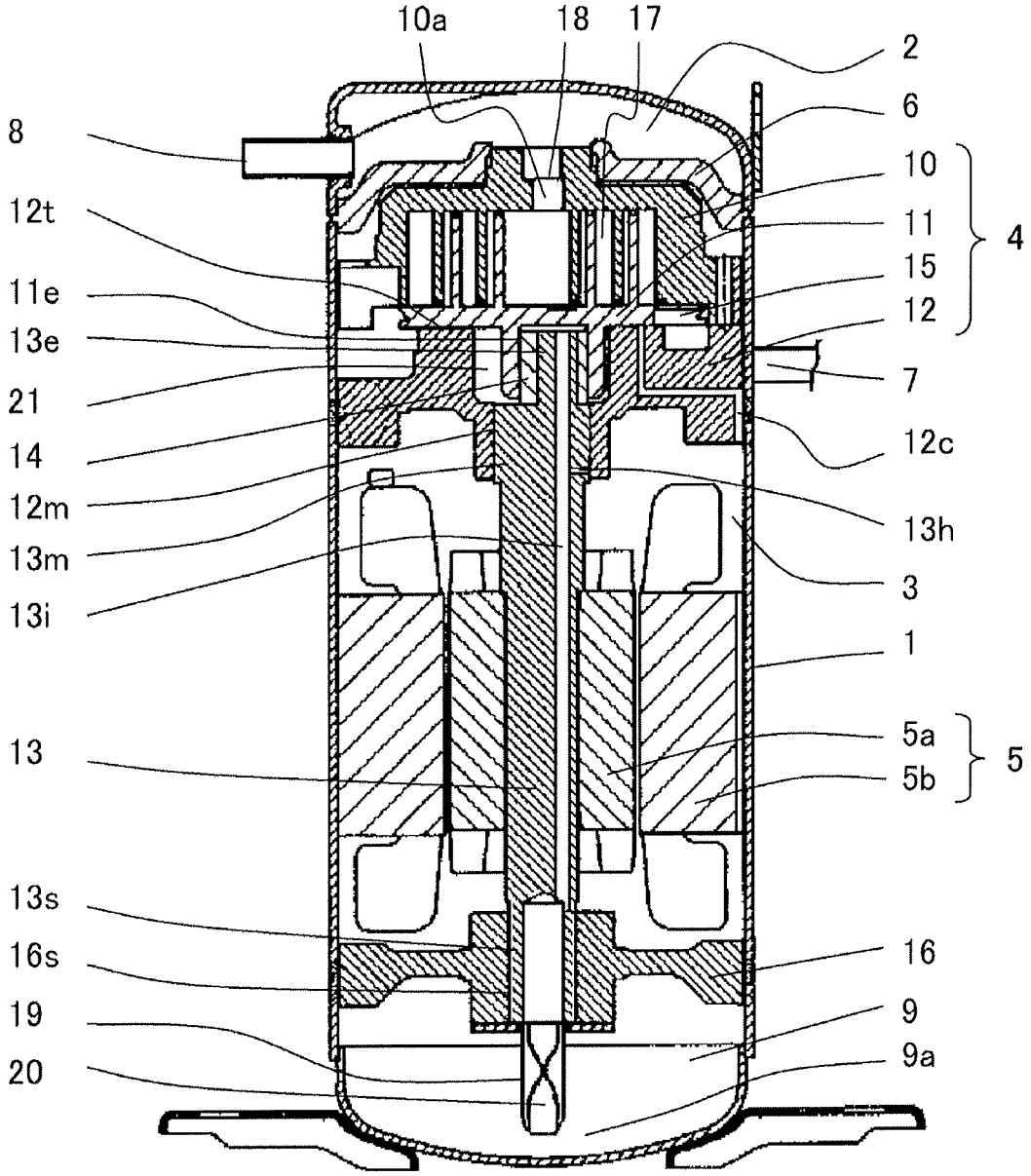
FIG. 1 is a vertical sectional view of a compressor according to an embodiment of the present invention.

1 hermetic container
2 high pressure chamber
3 low pressure chamber
4 compression mechanism
5 motor
5*a* rotor
6 partition plate
10 fixed scroll
11 rotary scroll
11*e* eccentric bearing member
12 main frame
12*m* main bearing member
13 shaft
13*e* eccentric shaft
13*m* main shaft
13*s* auxiliary shaft
14 movable eccentric member
15 rotation-regulating mechanism
16 auxiliary shaft plate
16*s* auxiliary bearing member
D diameter of bearing member (Dm, De)
L length of bearing member (Lm, Le)
δ clearance

MODE FOR CARRYING OUT THE INVENTION

A first aspect of the invention provides a scroll compressor in which a compression mechanism and a motor are accommodated in a hermetic container, the compression mechanism comprises: a fixed scroll having a spiral lap rising from a paneling; a rotary scroll having a spiral lap also rising from a paneling, and meshing with the fixed scroll to form a plurality of compression chambers; a shaft; a main frame supporting the shaft; and a rotation-regulating mechanism for regulating an attitude of the rotary scroll, and in which an eccentric shaft is integrally formed on one end of the shaft, the eccentric shaft is fitted into an eccentric bearing member formed in the rotary scroll, a main shaft of the shaft is fitted into a main bearing member formed in the main frame, refrigerant compressed by the compression mechanism is discharged from a discharge port of the fixed scroll, wherein when a diameter of the main bearing member is defined as Dm and a length thereof is defined as Lm and a diameter of an eccentric bearing member is defined as De and a length thereof is defined as Le, a ratio (=Lm/Dm) of the length and the diameter of the main bearing member and a ratio (=Le/De) of the length and the diameter of the eccentric bearing member satisfy a relation $Le/De \leq Lm/Dm \leq 1$.

According to this configuration, it is possible to prevent so-called twisting in which when a shaft inclines, and the shaft comes into contact with the edge portions of both ends of the bearing member. That is, since it is possible to prevent a surface pressure from increasing, it is possible to suppress local wear of the bearing member and the shaft.

Further, according to this configuration, it is possible to ensure reliability of the bearing member, especially reliability of the eccentric bearing member without increasing a length of the main bearing member. That is, it is possible to reduce a viscosity loss generated if oil exists between the main bearing member and the main shaft, and high reliability can be realized.

According a second aspect of the invention, in the first aspect, a partition plate is provided in the hermetic container, the compression mechanism and the motor are accommodated in a lower low pressure chamber which is partitioned by the partition plate, and refrigerant compressed by the compression mechanism is discharged, through the discharge port of the fixed scroll, into an upper high pressure chamber which is partitioned by the partition plate.

According to this configuration, even when a tilting phenomenon of the rotary scroll is prone to be generated, it is possible to suppress local wear of the eccentric bearing member and the eccentric shaft.

According to a third aspect, in the first or second aspect, the ratio (=Le/De) of the length and the diameter of the eccentric bearing member is 0.5 or higher.

According to this configuration, it is possible to reduce a viscosity loss caused by oil, and to prevent twisting from generating.

According to a fourth aspect of the invention, in any one of the first to third aspects, the shaft includes a rotor, an auxiliary shaft is formed on the shaft located on a side opposite from the main shaft with respect to the rotor, and an auxiliary bearing member which supports the auxiliary shaft is placed in the hermetic container.

According to this configuration, the shaft is supported by two points, i.e., the main shaft and the auxiliary shaft. Therefore, it is possible to suppress the inclination of the shaft and to suppress a bending amount, and generation of twisting can further be prevented.

According to a fifth aspect of the invention, in any one of the first to fourth aspects, a clearance between the main bearing member and the main shaft, a clearance between the eccentric bearing member and the eccentric shaft, and a clearance between the auxiliary bearing member and the auxiliary shaft are 10/10,000 to 40/10,000 times of diameters of the main bearing member, the eccentric bearing member and the auxiliary bearing member, respectively.

According to this configuration, inclinations of the shafts of various portions and a bending amount can be absorbed by clearances of various portions and generation of twisting can be prevented.

According to a sixth aspect of the invention, in any one of the first to fifth aspects, the eccentric shaft includes a movable eccentric member.

According to this configuration, even when the clearances of the various portions are set widely, since the rotary scroll and the fixed scroll reliably have contact points during operation, it is possible to provide a scroll compressor having both high reliability and high efficiency.

An embodiment of the present invention will be described below with reference to the drawings. The invention is not limited to the embodiment.

(Embodiment)

FIG. 1 is a vertical sectional view of a compressor according to the embodiment of the present invention. As shown in FIG. 1, the compressor according to the embodiment includes a compression mechanism 4 for compressing refrigerant gas and a motor 5 for driving the compression mechanism 4, and the compression mechanism 4 and the motor 5 are accommodated in a hermetic container 1.

An interior of the hermetic container 1 is partitioned by a partition plate 6 into an upper high pressure chamber 2 and a lower low pressure chamber 3. The compression mechanism 4, the motor 5 and an oil reservoir 9 in which oil 9*a* is stored are placed in the low pressure chamber 3.

A suction pipe 7 and a discharge pipe 8 are fixed to the hermetic container 1 by welding. The suction pipe 7 and the discharge pipe 8 are in communication with an exterior of the hermetic container 1, and are connected to members which configure a refrigeration cycle. Refrigerant gas is introduced into the hermetic container 1 from the exterior of the hermetic container 1 through the suction pipe 7, and compressed refrigerant gas is sent to outside of the hermetic container 1 from the high pressure chamber 2 through the discharge pipe 8.

A main frame 12 is fixed in the hermetic container 1 by welding or shrink fitting, and the main frame 12 pivotally supports a shaft 13. A fixed scroll 10 is fixed to the main frame 12 through a bolt. A rotary scroll 11 meshes with the fixed scroll 10, and the rotary scroll 11 is sandwiched between the main frame 12 and the fixed scroll 10. The main frame 12, the fixed scroll 10 and the rotary scroll 11 configure the scroll type compression mechanism 4.

If refrigerant gas is compressed, since pressure of the refrigerant gas is increased, pressure of the refrigerant gas is applied to the rotary scroll 11 in a direction separating away from the fixed scroll 10. Hence, the rotary scroll 11 receives pressure of the refrigerant gas by a thrust bearing 12*t* formed on the main frame 12. Since the rotary scroll 11 and the fixed scroll 10 are separated from each other by the pressure of the compressed refrigerant gas, chip seals are attached to lap tip ends of the rotary scroll 11 and the fixed scroll 10. According to this, leakage of refrigerant gas from gaps of the lap tip ends is suppressed, and high compression efficiency is realized.

A positional relation between the rotary scroll 11 and the fixed scroll 10 is restricted by a rotation-regulating mechanism 15 such as an Oldham ring. The rotation-regulating mechanism 15 prevents the rotary scroll 11 from rotating, and also guides the rotary scroll 11 so that it moves in a circular orbit manner. The rotary scroll 11 is eccentrically driven by fitting a movable eccentric member 14 over an eccentric shaft 13*e* provided on an upper end of the shaft 13. By this eccentric driving operation, a compression chamber 17 formed between the fixed scroll 10 and the rotary scroll 11 moves from an outer periphery toward a center of the fixed scroll 10 to reduce a capacity of the compression chamber 17, thereby carrying out a compressing operation.

The motor 5 is composed of a stator 5*b* fixed to an inner wall surface of the hermetic container 1, and a rotor 5*a* which is rotatably supported by an inner side of the stator 5*b*. The shaft 13 is coupled to the rotor 5*a* in a penetrating state. One of ends of the shaft 13 is a main shaft 13*m*, and the main shaft 13*m* is rotatably supported by a main bearing member 12*m* provided on the main frame 12. The other end of the shaft 13 is an auxiliary shaft 13*s*, and the auxiliary shaft 13*s* is rotatably supported by an auxiliary bearing member 16*s* provided on an auxiliary shaft plate 16.

Next, flow of refrigerant gas will be described.

Refrigerant gas sucked from the suction pipe 7 is guided into the hermetic container 1, a portion of the refrigerant gas is supplied directly to the compression mechanism 4, other portion of the refrigerant gas cools the motor 5 and then, this refrigerant gas is supplied to the compression mechanism 4. According to this, the motor 5 is cooled, and control is performed such that winding temperature of the motor 5 does not exceed a predetermined value. Refrigerant gas supplied to the compression mechanism 4 is compressed by capacity variation of the compression chamber 17, and the refrigerant gas moves toward centers of the fixed scroll 10 and the rotary scroll 11. A discharge port 10*a* is formed in a central portion of the fixed scroll 10. The discharge port 10*a* is provided with a check valve 18 such as a reed valve and a float valve. If pressure reaches a predetermined value, the refrigerant gas pushes the check valve 18 open, the refrigerant gas flows into the high pressure chamber 2 and is sent from the discharge pipe 8 into the refrigeration cycle.

Next, flow of oil 9*a* will be described.

An oil pickup 19 is attached to a lower end of the shaft 13, and an oil panel 20 is provided in the oil pickup 19. If the shaft 13 rotates, oil 9*a* in the oil reservoir 9 is sucked up by the oil panel 20 and then, the oil 9*a* flows upward in an oil passage 13*i* formed in the shaft 13. The oil passage 13*i* is formed in a state where it is eccentric with respect to a center of a rotation shaft, and a centrifugal force acts on the oil 9*a*. According to this, the oil 9*a* is guided to the main shaft 13*m* of the shaft 13 and to the end of the shaft 13. The oil 9*a* which reaches the main shaft 13*m* passes through a lateral hole 13*h* formed in the shaft 13, the oil 9*a* is supplied to a fitting portion between the main bearing member 12*m* and the main shaft 13*m* and the oil 9*a* functions as lubricant oil. Similarly, oil 9*a* which reaches the end of the shaft 13 is supplied to a fitting portion between an eccentric bearing member 11*e* and the eccentric shaft 13*e*, and the oil 9*a* functions as lubricant oil. The oil 9*a* which lubricated the fitting portions of the bearings reaches a back space 21 which is surrounded by the main frame 12 and a paneling of the rotary scroll 11. Thereafter, the oil 9*a* lubricates the thrust bearing 12*t*, the oil 9*a* is guided to an inner peripheral surface of the hermetic container 1 through an interior passage 12*c* of the main frame 12, passes through a notch and the like of the stator 5*b* and returns to the oil reservoir 9.

Configurations of the bearings according to the embodiment will be described below.

In the case of the journal bearing, generally, surface pressure is reduced by increasing a length thereof in its axial direction to ensure reliability. Especially, a gas compression force acts on the eccentric shaft 13*e* and bending is generated in the shaft 13 by a load of the gas compression force. Therefore, the shaft 13 comes into contact with edge portions of both ends of the eccentric bearing member 11*e*, and so-called twisting is prone to occur. If the twisting occurs, since a contact area between the eccentric bearing member lie and the eccentric shaft 13*e* becomes extremely small, surface pressure becomes extremely large, and local wear is generated in the eccentric bearing member 11*e* or the eccentric shaft 13*e* . If the operation of the compressor is continued in this state, there is fear that the wear progresses and reliability is deteriorated. This phenomenon is not limited to the eccentric bearing member 11*e* and the eccentric shaft 13*e*, and the same phenomenon may occur in the main bearing member 12*m* and the main shaft 13*m*.

Figure 2:
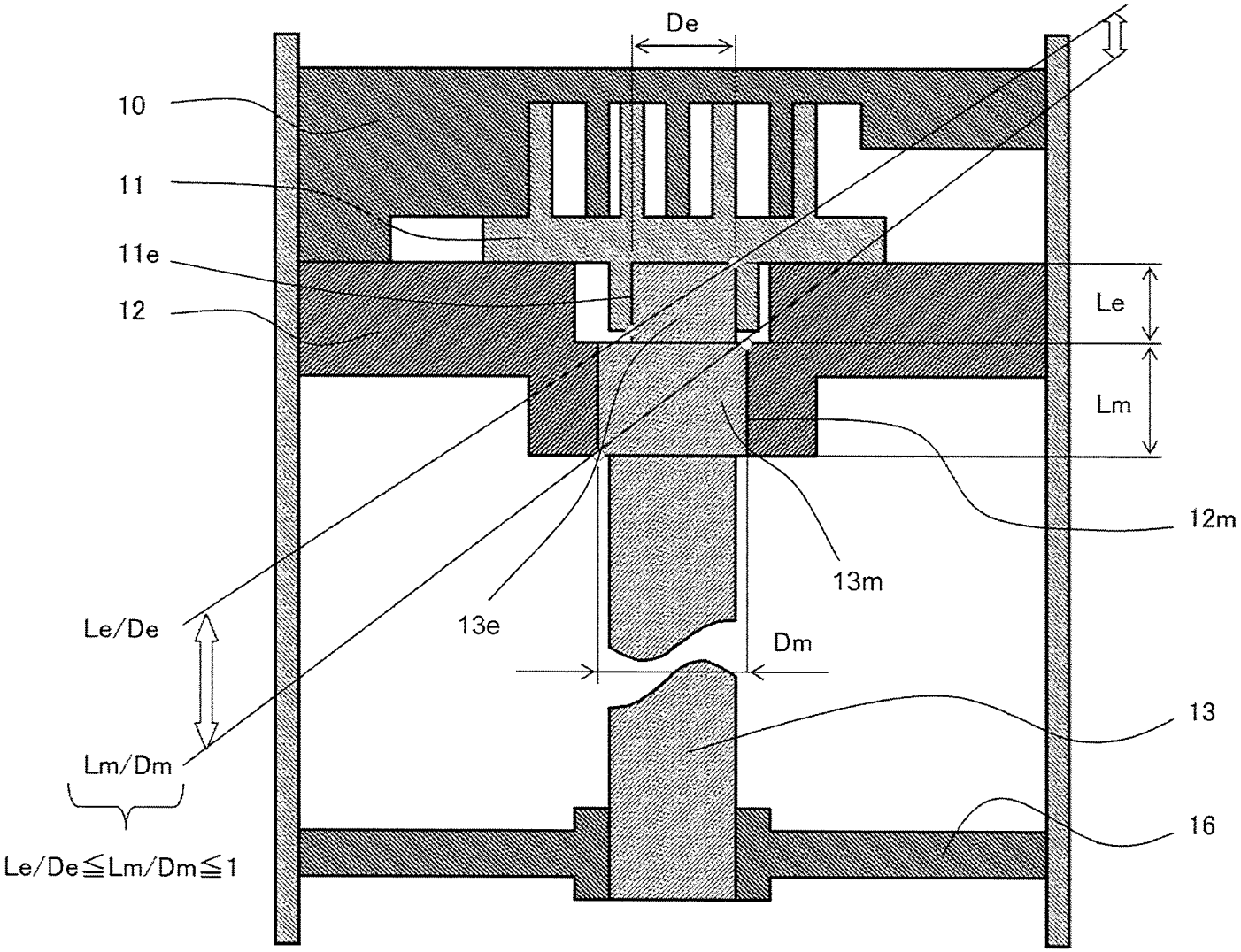
FIG. 2 is a schematic sectional view of the compressor according to the embodiment of the invention.

FIG. 2 is a schematic sectional view of the compressor.

As shown in FIG. 2, a diameter of the main bearing member 12*m* is defined as Dm, a length thereof is defined as Lm, a diameter of the eccentric bearing member 11*e* is defined as De and a length thereof is defined as Le. At this time, if a relation between a ratio (=Lm/Dm) of the length and the diameter of the main bearing member 12*m* and a ratio (=Le/De) of the length and the diameter of the eccentric bearing member 11*e* is set to Le/De≤Lm/Dm≤1, it is possible to prevent the twisting.

More specifically, since the eccentric bearing member 11*e* is more flat than the main bearing member 12*m*, tolerance with respect to the inclination of the eccentric bearing member 11*e* is increased. In other words, even if the eccentric shaft 13*e* inclines, the eccentric shaft 13*e* does not come into contact with the edge portions of the both ends of the eccentric bearing member 11*e*. To prevent contact at the edge portions of the both ends of the main bearing member 12*m* even if the main shaft 13*m* inclines, and to reduce, to the utmost, a viscosity loss of the main bearing member 12*m* caused by oil 9*a*, it is preferable that the ratio (=Lm/Dm) of the length and the diameter is set to 1 or less. This embodiment is based on the assumption that clearances between the bearing members 12*m*, 11*e*, 16*s* and the shafts 13*e*, 13*m*, 13*s* are set with a constant ratio with respect to the diameters, but under this condition, the more flat the bearing member becomes, the higher the tolerance with respect to inclination becomes. Therefore, contact at the edge portions of the both ends of the eccentric bearing member 11*e* is avoided. From the above reason, in this embodiment, a scroll compressor having both high reliability and high efficiency can be realized.

As described above, the partition plate 6 is provided in the hermetic container 1, and the partition plate 6 partitions the hermetic container 1 into the upper high pressure chamber 2 and the lower low pressure chamber 3. The compression mechanism 4 and the motor 5 are accommodated in the low pressure chamber 3, refrigerant gas compressed by the compression mechanism 4 is discharged, through the discharge port 10*a* of the fixed scroll 10, into the high pressure chamber 2 which is partitioned by the partition plate 6. In this case, since the compression mechanism 4 is placed in the low pressure chamber 3, the rotary scroll 11 receives a force basically in a direction separating away from the fixed scroll 10. Hence, when the compressor is actuated or when pressure is transited, balance of forces in the axial direction of the rotary scroll 11 is lost, and a tilting phenomenon is prone to be generated. In this embodiment, the ratio (=Le/De) of the length and the diameter of the eccentric bearing member 11*e* is smaller than the ratio (=Lm/Dm) of the length and the diameter of the main bearing member 12*m*. Hence, even if the tilting phenomenon is generated, contact at the edge portions of the both ends of the eccentric bearing member 11*e* is avoided. That is, in a low pressure type compressor in which the compression mechanism 4 is accommodated in the low pressure chamber 3, the effect of this embodiment is exerted more clearly, and local wear of the eccentric bearing member 11*e* and the eccentric shaft 13*e* is suppressed. Hence, it is possible to provide a scroll compressor having high reliability.

If the ratio (=Le/De) of the length and the diameter of the eccentric bearing member 11*e* is set to 0.5 or higher, it is possible to reduce the viscosity loss caused by the oil 9*a* and to prevent the twisting. If the ratio (=Le/De) of the length and the diameter of the eccentric bearing member lie becomes lower than 0.5, an oil film is not sufficiently formed between the eccentric bearing member 11*e* and the eccentric shaft 13*e* and as a result, the eccentric bearing member lie and the eccentric shaft 13*e* come into contact with each other. Hence, there is fear that not only performance but also reliability are deteriorated. For this reason, it is preferable that the ratio (=Le/De) of the length and the diameter of the eccentric bearing member 11*e* is set to 0.5 or higher.

The shaft 13 is provided with the rotor 5*a*, the auxiliary shaft 13*s* is formed on the opposite side from the main shaft 13*m* through the rotor 5*a*, and the auxiliary bearing member 16*s* which supports the auxiliary shaft 13*s* is placed in the hermetic container 1. According to this, since the shaft 13 is supported by the two points, i.e., the main shaft 13*m* and the auxiliary shaft 13*s*, it is possible to suppress the inclination of the shaft 13 and the bending amount. That is, since the inclination of the main shaft 13*m* with respect to the main bearing member 12*m* and the inclination of the eccentric shaft 13*e* with respect to the eccentric bearing member 11*e* become small, it is possible to further prevent the twisting from generating.

Figure 3:
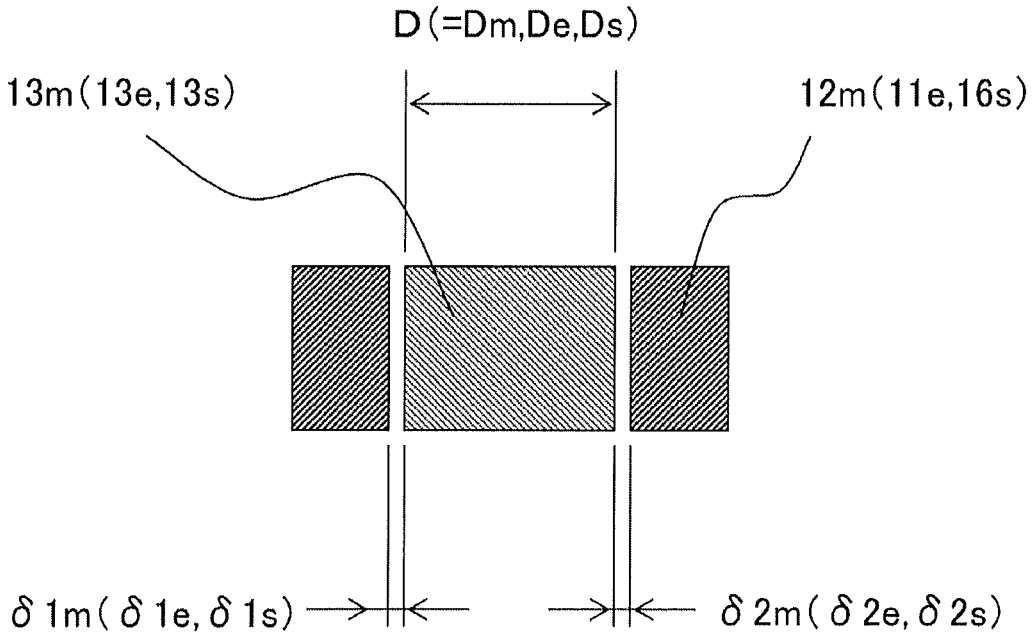
FIG. 3 is an enlarged sectional view of a bearing according to the embodiment of the invention.

FIG. 3 is an enlarged sectional view of the bearing. As shown in FIG. 3, clearances δ of the bearing members 12*m*, 11*e* and 16*s* are set based on a ratio with respect to the diameters D. More specifically, a clearance δ*m* between the main bearing member 12*m* and the main shaft 13*m*, a clearance δ*e* between the eccentric bearing member 11*e* and the eccentric shaft 13*e*, and a clearance δ*s* between the auxiliary bearing member 16*s* and the auxiliary shaft 13*s* are set to 10/10,000 to 40/10,000 times of the diameters D (=Dm, De, Ds) of the bearing members 12*m*, 11*e* and 16*s*, respectively. According to this, the inclination of the shaft 13 in the bearings and bending amounts can be absorbed by the clearances δ*m*, δ*e* and δ*s*, and it is possible to prevent the twisting from generating. If the clearances δ*m*, δ*e* and δ*s* are less than 10/10,000 times, tolerance with respect to the inclination of the shaft 13 becomes low, and there is fear that contact is generated at the edge portions of the both ends of the eccentric bearing member 11*e*. If the clearances δ*m*, δ*e* and δ*s* exceeds 40/10,000 times, although the tolerance with respect to inclination becomes high, since the clearance δ is excessively large, the clearance δ becomes an escapeway of a compression force of refrigerant gas, and an oil film force is less prone to be applied. From this reason, it is preferable that the clearances δ*m*, δ*e* and δ*s* are in a range of 10/10,000 to 40/10,000 times of the diameters D (=Dm, De, Ds) of the bearing members 12*m*, 11*e* and 16*s*.

As shown in FIG. 1, since the eccentric shaft 13*e* is provided with the movable eccentric member 14, performance can be stabilized. If the movable eccentric member 14 is used, it is possible to positively push a lap wall surface of the rotary scroll 11 against a lap wall surface of the fixed scroll 10 utilizing a compression force of refrigerant gas. Hence, also when the clearances of the bearing members 12*m*, 11*e* and 16*s* are widely set, if the movable eccentric member 14 is employed, a lap of the rotary scroll 11 and a lap of the fixed scroll 10 reliably have contact points in the radial direction. Hence, it is possible to provide a scroll compressor having both the high reliability and the high efficiency.

INDUSTRIAL APPLICABILITY

The present invention can be applied to small to large scroll compressors, and can be provided in an air conditioner such as a room air conditioner, a heat pump type water heater, a heat pump type hot water heater and a freezer which are products. According to this, it is possible to realize an energy-saving, environment-friendly and comfortable product.

The invention claimed is:

1. A scroll compressor in which a compression mechanism and a motor are accommodated in a hermetic container, the compression mechanism comprises:

a fixed scroll having a spiral lap rising from a paneling;

a rotary scroll having a spiral lap also rising from a paneling, and meshing with the fixed scroll to form a plurality of compression chambers;

a shaft;

a main frame for supporting the shaft; and a rotation-regulating mechanism for regulating an attitude of the rotary scroll, and in which an eccentric shaft is integrally formed on one end of the shaft, the eccentric shaft is fitted into an eccentric bearing member formed in the rotary scroll, a main shaft of the shaft is fitted into a main bearing member formed in the main frame, refrigerant compressed by the compression mechanism is discharged from a discharge port of the fixed scroll, wherein when a diameter of the main bearing member is defined as Dm and a length thereof is defined as Lm and a diameter of the eccentric bearing member is defined as De and a length thereof is defined as Le, a ratio (=Lm/Dm) of the length and the diameter of the main bearing member and a ratio (=Le/De) of the length and the diameter of the eccentric bearing member satisfy a relation $Le/De \leq Lm/Dm \leq 1$, and a clearance between the main bearing member and the main shaft, a clearance between the eccentric bearing member and the eccentric shaft, and a clearance between an auxiliary shaft of the shaft located on a side of the main shaft and an auxiliary bearing member that supports the auxiliary shaft are 10/10,000 to 40/10,000 times of the diameter Dm of the main bearing member, the diameter De of the eccentric bearing member and a diameter of the auxiliary bearing member respectively.

2. The scroll compressor according to claim 1, wherein a partition plate is provided in the hermetic container, the compression mechanism and the motor are accommodated in a lower low pressure chamber which is partitioned by the partition plate, and refrigerant compressed by the compression mechanism is discharged, through the discharge port of the fixed scroll, into an upper high pressure chamber which is partitioned by the partition plate.

3. The scroll compressor according to claim 1, wherein the ratio (=Le/De) of the length and the diameter of the eccentric bearing member is 0.5 or higher.

4. The scroll compressor according to claim 1, wherein the shaft includes a rotor, the auxiliary shaft is formed on the shaft located on a side opposite from the main shaft with respect to the rotor, and the auxiliary bearing member is in the hermetic container.

5. scroll compressor according to claim 1, wherein the eccentric shaft includes a movable eccentric member.

* * * * *